US010378783B2

(12) United States Patent
Tun

(10) Patent No.: US 10,378,783 B2
(45) Date of Patent: Aug. 13, 2019

(54) BLOWING SYSTEM WITH EXPANDABLE FUNCTIONS, EXPANSION DEVICE, AND OPERATING METHOD

(71) Applicant: JIYONSON CO., LTD., Taipei (TW)

(72) Inventor: Yun-Long Tun, New Taipei (TW)

(73) Assignee: JIYONSON CO., LTD., Taipei (TW)

( * ) Notice: Subject to any disclaimer, the term of this patent is extended or adjusted under 35 U.S.C. 154(b) by 0 days.

(21) Appl. No.: 15/260,480

(22) Filed: Sep. 9, 2016

(65) Prior Publication Data

US 2017/0065998 A1 Mar. 9, 2017

(30) Foreign Application Priority Data

Sep. 9, 2015 (TW) ..... 104129835 A

(51) Int. Cl.

| | |
|---|---|
| ***F24F 6/00*** | (2006.01) |
| ***F24F 6/14*** | (2006.01) |
| ***A45D 20/12*** | (2006.01) |
| ***A45D 19/16*** | (2006.01) |
| ***A45D 20/10*** | (2006.01) |
| ***B05B 7/00*** | (2006.01) |
| *D06F 87/00* | (2006.01) |

(Continued)

(52) U.S. Cl.

CPC ..... *F24F 6/14* (2013.01); *A45D 19/16* (2013.01); *A45D 20/10* (2013.01); *A45D 20/12* (2013.01); *A45D 20/122* (2013.01); *B05B 7/0075* (2013.01); *A45D 2200/20* (2013.01); *B05B 7/2416* (2013.01); *B05B 17/0615* (2013.01); *D06F 87/00* (2013.01); *F24F 2006/008* (2013.01); *F24F 2006/143* (2013.01)

(58) Field of Classification Search

CPC ..... A45D 19/16; A45D 20/00; A45D 20/12; B05B 7/0075; F24F 6/14; F24F 6/18

USPC ..... 239/8, 310, 398, 654; 261/30, 78.2, 81; 34/96, 97, 283

See application file for complete search history.

(56) References Cited

U.S. PATENT DOCUMENTS 2,420,732 A * 5/1947 Bichsel ..... A45D 20/10 34/97

3,042,314 A * 7/1962 Packard ..... B05B 7/2443 239/310

(Continued)

FOREIGN PATENT DOCUMENTS

CN 204070979 U 1/2015

*Primary Examiner* — Viet Le

(74) *Attorney, Agent, or Firm* — Li & Cai Intellectual Property (USA) Office

(57) ABSTRACT

The disclosure is related to a blowing apparatus with expandable functions, an expansion device, and an operating method. The blowing apparatus has an electrical interface used to connect one of the expansion devices with various functions. The blowing apparatus has a control unit used to identify an operating mode of the expansion device connected with the blowing apparatus. A control signal is therefore generated. According to the control signal, the control unit controls rotating speed of a fan unit and a heating temperature of a heating unit. The expansion device can be disposed with a mist unit having a container and a mist generating unit. The mist unit sprays the mist to an outlet cap of the expansion device. The blowing apparatus then blows the mist out of the outlet cap by means of the rotating speed of fan unit and the temperature of heating unit.

10 Claims, 9 Drawing Sheets

(51) Int. Cl.
*B05B 7/24* (2006.01)
*B05B 17/06* (2006.01)

(56) References Cited

U.S. PATENT DOCUMENTS 3,745,306 A * 7/1973 Naritomi ..... A45D 7/00 34/97
3,905,379 A * 9/1975 Churas ..... A45D 20/10 132/272
4,114,022 A * 9/1978 Braulke, III ..... A45D 20/00 132/212
4,555,232 A * 11/1985 Raccah ..... A45D 20/06 126/401
4,711,988 A * 12/1987 Thaler ..... A45D 20/10 219/486
4,827,105 A * 5/1989 Brown, Jr. ..... A45D 20/12 219/222
5,238,154 A * 8/1993 Zuriel ..... B05B 7/1436 222/189.06
5,394,620 A * 3/1995 Chimera ..... A45D 20/10 34/97
5,572,800 A * 11/1996 West ..... A45D 20/12 34/390
5,761,824 A * 6/1998 Moon ..... A45D 20/12 34/97
5,857,262 A * 1/1999 Bonnema ..... A45D 20/06 126/409
5,966,833 A * 10/1999 Andis ..... A45D 20/122 34/283
6,357,532 B1 * 3/2002 Laskaris ..... A62C 5/00 169/14
6,763,606 B2 * 7/2004 Saida ..... A45D 20/00 34/96
6,775,922 B2 * 8/2004 Langley ..... A45D 20/12 34/96
6,886,373 B2 * 5/2005 Carrubba ..... D06F 73/00 68/222
6,896,203 B1 * 5/2005 Restive ..... B05B 7/1254 239/302
6,922,909 B2 * 8/2005 Andrew ..... A45D 20/122 132/271
6,966,125 B2 * 11/2005 Rago ..... A45D 20/12 132/212
6,986,217 B2 * 1/2006 Leung ..... D06F 73/00 38/77.83
7,040,021 B2 * 5/2006 Talavera ..... B26B 19/16 30/124
7,047,660 B2 * 5/2006 Leventhal ..... A45D 20/122 34/97
7,207,501 B2 * 4/2007 Hanratty ..... A62C 5/02 169/14
7,641,133 B2 * 1/2010 Wilfert ..... B08B 3/026 239/310
7,676,952 B2 * 3/2010 Nakagawa ..... A45D 20/12 239/690
7,926,198 B2 * 4/2011 Merritt ..... A45D 20/12 34/283
7,992,809 B1 * 8/2011 Barnett ..... B05B 7/0416 222/190
8,132,571 B1 * 3/2012 Jackson ..... A45D 1/04 132/211
8,998,111 B2 * 4/2015 Sun ..... B05B 1/3013 239/302
9,756,922 B1 * 9/2017 Duthe ..... A45D 20/12
2001/0020649 A1 * 9/2001 Miquel ..... F04F 5/461 239/310
2002/0030121 A1 * 3/2002 Kyotani ..... F04F 5/16 239/310
2003/0150126 A1 * 8/2003 Chang ..... A45D 20/122 34/96
2003/0163930 A1 * 9/2003 Feldman ..... A45D 20/10 34/96
2003/0177657 A1 * 9/2003 Andis ..... A45D 20/122 34/96
2005/0108889 A1 * 5/2005 Leventhal ..... A45D 20/122 34/96
2005/0198855 A1 * 9/2005 Cafaro ..... A45D 20/10 34/97
2005/0248044 A1 * 11/2005 Kim ..... F24F 6/12 261/81
2006/0060991 A1 * 3/2006 Holsteyns ..... B08B 3/02 261/81
2006/0237860 A1 * 10/2006 Huang ..... B05B 17/0615 261/81
2006/0290014 A1 * 12/2006 Swoboda ..... C02F 1/36 261/36.1
2007/0152356 A1 * 7/2007 Huang ..... F24F 6/00 261/81
2008/0116753 A1 * 5/2008 Carlucci ..... A45D 20/10 310/50
2008/0229606 A1 * 9/2008 Hirai ..... A45D 20/12 34/97
2008/0236604 A1 * 10/2008 Mourad ..... A45D 1/04 132/118
2010/0133707 A1 * 6/2010 Huang ..... A61L 9/20 261/81
2011/0031636 A1 * 2/2011 Ediger ..... F24F 6/12 261/78.2
2011/0221078 A1 * 9/2011 Lev ..... A61L 9/03 261/81
2011/0277335 A1 * 11/2011 Prehodka ..... A45D 20/12 34/96
2013/0133218 A1 * 5/2013 Hadden ..... A45D 20/10 34/97
2013/0168880 A1 * 7/2013 Duke ..... A24F 47/008 261/78.2
2013/0291394 A1 * 11/2013 Shami ..... A45D 20/10 34/88
2014/0338211 A1 * 11/2014 Kaizuka ..... A45D 20/122 34/97
2015/0272879 A1 * 10/2015 Simonyan ..... B05B 7/0012 424/725
2015/0366316 A1 * 12/2015 Soresina ..... A45D 20/12 34/97
2017/0065998 A1 * 3/2017 Tun ..... A45D 20/122

* cited by examiner

BLOWING SYSTEM WITH EXPANDABLE FUNCTIONS, EXPANSION DEVICE, AND OPERATING METHOD

BACKGROUND OF THE INVENTION

1. Field of the Invention

The present invention is related to a blowing system including a blowing apparatus and a related expansion device; in particular to the blowing apparatus that is able to automatically tune its operating parameters according to an identification code, and its expansion device and an operating method for the blowing apparatus.

2. Description of Related Art

Appliances for specific uses are often seen in daily life. For example, the device for spraying mist, such as a garment steamer that uses steam to make clothes flat. In the operation of the garment steamer, the water in a container is heated so as to generate steam. The steam is sprayed out through a spout. The high-temperature steam makes the fibers of the hanging clothes to be flattened.

The mist device is such as a face-steaming device for beautifying skin. The mist device sprays the steam to the human face by heating the water to be steam that is guided to a human face. The steam renders the functions that are used to cleanse the skin and also make the skin tender.

A humidifier may be required in an indoor room when a user feels uncomfortable due to the relatively dry air. The mist sprayed out may make the indoor room slightly moist. Additionally, the water in the container may be added with fragrances or essential oils that are able to clean air.

However, according to the conventional technologies, they lack a solution for integrating the multiple functions since every steamer is merely used for one single function.

SUMMARY OF THE INVENTION

Various devices that are able to generate mist for achieving specific functions have the similar principle of operations. The mist device allows the water to be heated or vibrated to be steam out of its container. The disclosure in accordance with the present invention is related to a blowing system having a blowing apparatus capable of expanding its function, an expansion device, and an operating method. The expansion device may be the mist device.

According to one aspect of the present invention, the blowing apparatus in a system includes a control unit used to identify an operating mode of an expansion device of the blowing apparatus, and generate an identity signal according to the operating mode. The blowing apparatus has an electrical interface for connecting with the expansion device. The electrical interface includes one or more electrical pins and a connector that is used to electrically connect with and lock the expansion device.

The blowing apparatus includes a fan unit whose rotating speed is controllable in response to the identity signal generated by the control unit. The rotating speed can be adjustable/controllable. The blowing apparatus includes a heating unit. The temperature of the heating unit can be adjustable/controllable in response to the identity generated by the control unit.

According to one of the embodiments, the expansion device obtains electric power from its connected blowing apparatus. The expansion device may also have its independent power supply. The expansion device includes a connection interface having one or more contact pins corresponding to one or more electrical pins of the blowing apparatus. The connection interface of the expansion device has a connecting structure used to lock the blowing apparatus. The expansion device has an identification unit recording its operating mode. The identification unit is provided for the control unit of the blowing apparatus to identify the operating mode of the expansion device.

The expansion device can be a mist-type expansion device. The mist-type expansion device has a mist unit having a container and a mist generating unit. The mist generating unit vibrates the liquid in the container to generate/create the mist to an outlet cap of the expansion device. Then the fan unit blows/sucks the mist out of the expansion device with a rotating speed based on its operating mode; and/or the heating unit heats the mist to reach a temperature.

In the method for operating the blowing system with expandable function, the expansion device connected to the blowing apparatus is firstly identified to operate an operating mode from the identification unit. For example, the identification unit can identify the operating mode of the expansion device through the one or more electrical pins.

The identified operating mode controls a rotating speed of a fan unit, and/or a temperature of the heating unit of the blowing apparatus. In one embodiment, the mist generated by a mist unit can be blown/sucked out of an outlet cap of the expansion device.

DETAILED DESCRIPTION OF THE PREFERRED EMBODIMENTS

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art.

The disclosure in accordance with the present invention is related to a blowing system including a blowing apparatus and an expansion device. The blowing apparatus can operate as a normal hair dryer. Like a hair dryer, the blowing apparatus essentially has a grip, a rear-end inlet, a front-end outlet, and a switch. The switch can be used to switch the modes to various temperatures and fan speeds. Inside the blowing apparatus, the essential components for the apparatus to function such as a heating coil and a fan are included. The apparatus allows a user to switch the functions among some typical modes with various combinations of fan speeds and temperatures. The blowing apparatus in accordance with the present invention may include full or partial functional capability. The blowing apparatus can particularly function using parameters to operate the fan unit and heating unit therein due to its connected expansion device. The blowing apparatus is allowed to expand its functional capability while it connects with the various expansion devices in accordance with the present invention.

Figure 1A:
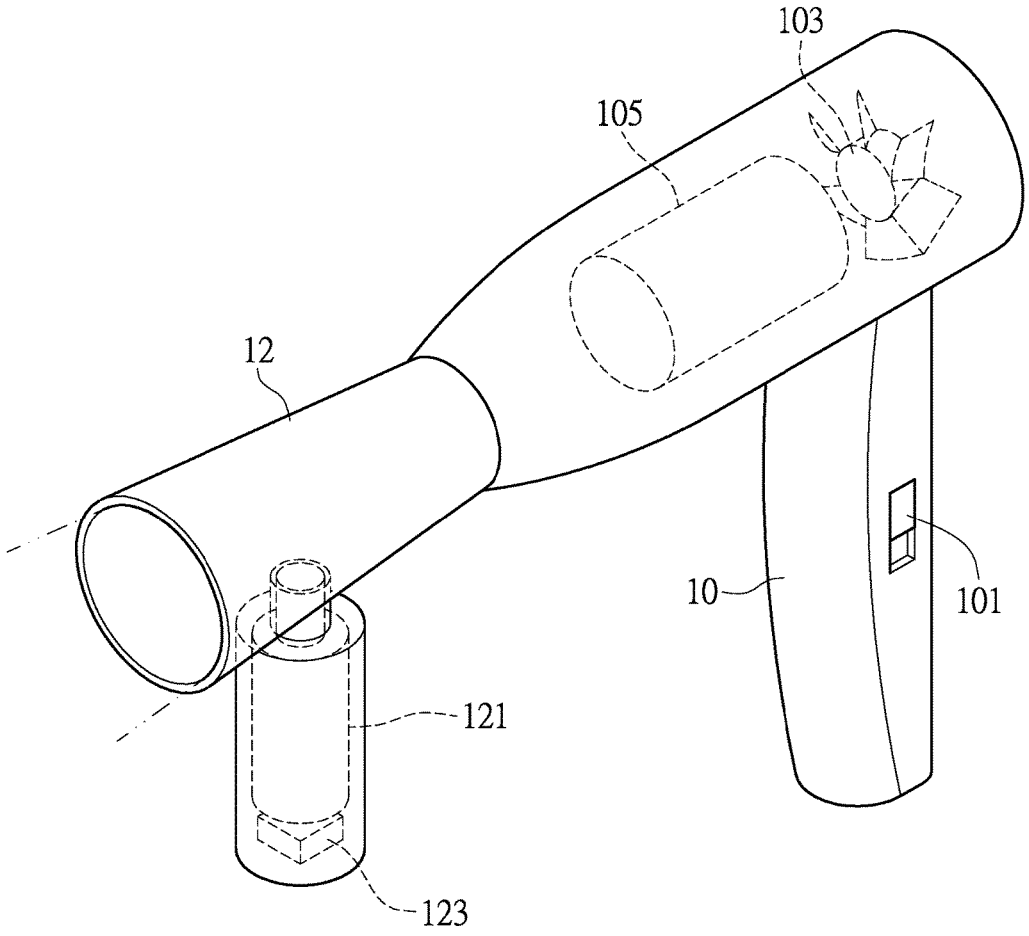
FIG. 1A shows a schematic diagram depicting a system including a blowing apparatus capable of expanding function and its expansion device in one embodiment of the present invention.

Reference is made to FIG. 1A depicting a system including a blowing apparatus and an expandable function according to one of the embodiments of the present invention.

The blowing apparatus 10 has a grip allowing a user to handhold the body of the apparatus 10. The blowing apparatus 10 has an outlet where the expansion device is mounted. In an exemplary example, the expansion device is such as a mist-type expansion device 12. It is noted that the scope of the expansion device for expanding the functions of the blowing apparatus 10 may not be limited to the embodiment described in this figure.

The mist-type expansion device has a container 121, as shown in the drawing, a fan unit of the blowing apparatus 10 blows out the articles in the container 121. For example, the container 121 contains soap water, and a stirrer, a vibrator, or a supersonic piezo actuator may be provided to create bubbles.

In a schematic diagram, the blowing apparatus 10 is equipped with a power switch 101 to turn on or turn off the apparatus 10. The power switch 101 can be used to select one of the multi-stage fan speeds and temperatures. The blowing apparatus 10 includes a control circuit (not shown in this figure). The primary components connected with the control circuit are such as a fan unit 103 and a heating unit 105. The rotating speed of the fan unit 103 and heating efficiency of the heating unit 105 can be automatically adjusted according to an identity signal.

A mechanical structure can be used to lock the expansion device 12 at the outlet of the blowing apparatus 10. Further, an electrical component can also be disposed at the outlet of the blowing apparatus 10. The expansion device 12, in the example, is a device for generating mist. The container 121 contains water, liquid, or other substance. A mist generating unit 123 is also included at a portion of the expansion device 12. The mist generating unit 123 is a kind of vibrator, or a supersonic piezo actuator, or a stirrer that is used to vibrate the substance in the container 121. The liquid or substance in the container 121 can be vibrated to form water/liquid mist or other misted substance. The mist may also be mixed with other substances.

The mist-type expansion device 12 exemplarily forms an outlet cap combined with the blowing apparatus 10. The shape of the outlet cap may be altered based on its proprietary function. One of the objectives is to blow out the mist for a specific purpose. The blowing apparatus 10 is cooperated with the mist-type expansion device 12 for providing corresponding fan speed and temperature of air.

It is noted that the mist-type expansion device may be the expansion device for generating steam or bubbles by heating the substance in the container of the expansion device.

Figure 1B:
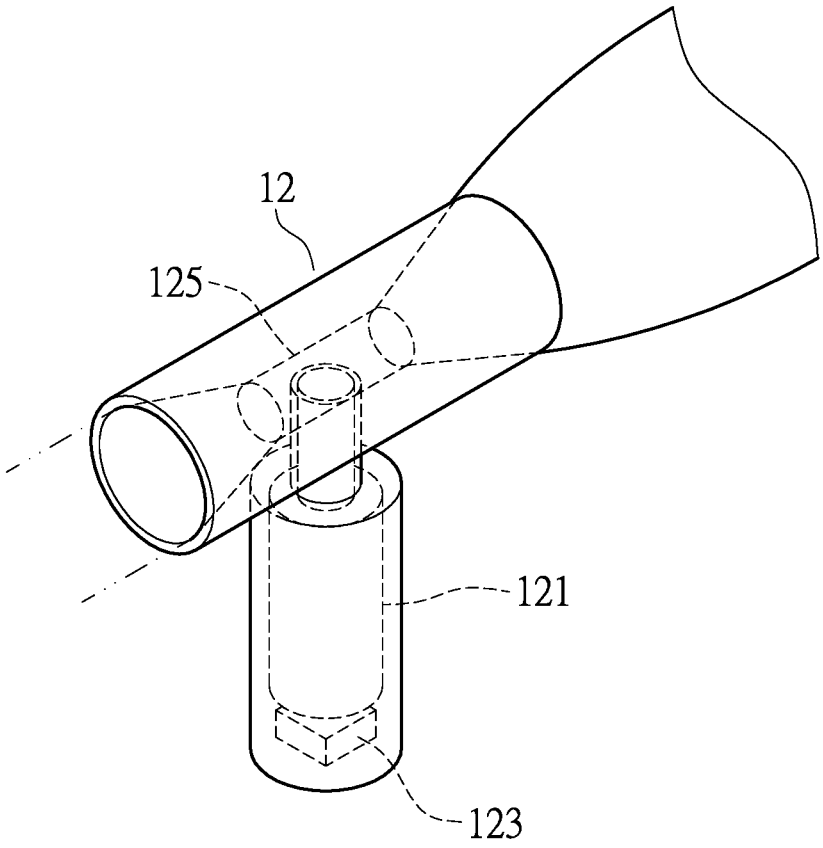
FIG. 1B shows one more schematic diagram depicting the system including the blowing apparatus and an expansion device with Venturi tube and mist generating unit in another embodiment of the present invention.

FIG. 1B shows another diagram depicting the blowing system with the apparatus and another expansion device in accordance with the present invention. For enhancing the effect of spraying the mist, an airflow tube 125, e.g. a venturi tube, may be included in the mist-type expansion device 12. It is noted that the venturi tube with an altering cross section can be disposed inside the outlet cap of the expansion device. In the example shown in the diagram, the airflow tube 125 has double tapers that alter from a bigger cross section, to a smaller cross section and to another bigger cross section. The continuous changes of areas of the cross sections of the airflow tube 125 generate pressure difference that changes the speed of fluid in the tube 125. According to a principle of equal volume of fluid flowing through every cross section in the tube at the same time, the cross section with smaller area increases a flow rate with smaller pressure when the blowing apparatus 10 generates air flow into the tube 125. Further, the use of smaller pressure can inhale more mist and also enhance the effect of the mist.

The diagram shows the airflow tube 125 with altering cross sections is disposed in the outlet cap of the expansion device 12. The airflow tube 125 changes the flow rate of the mist sprayed to the outlet cap. When the mist generating unit 123 vibrates the substance in the container 121, the mist enters the airflow tube 125, and the enhanced air flow pushes the mist out of the outlet cap.

Figure 2:
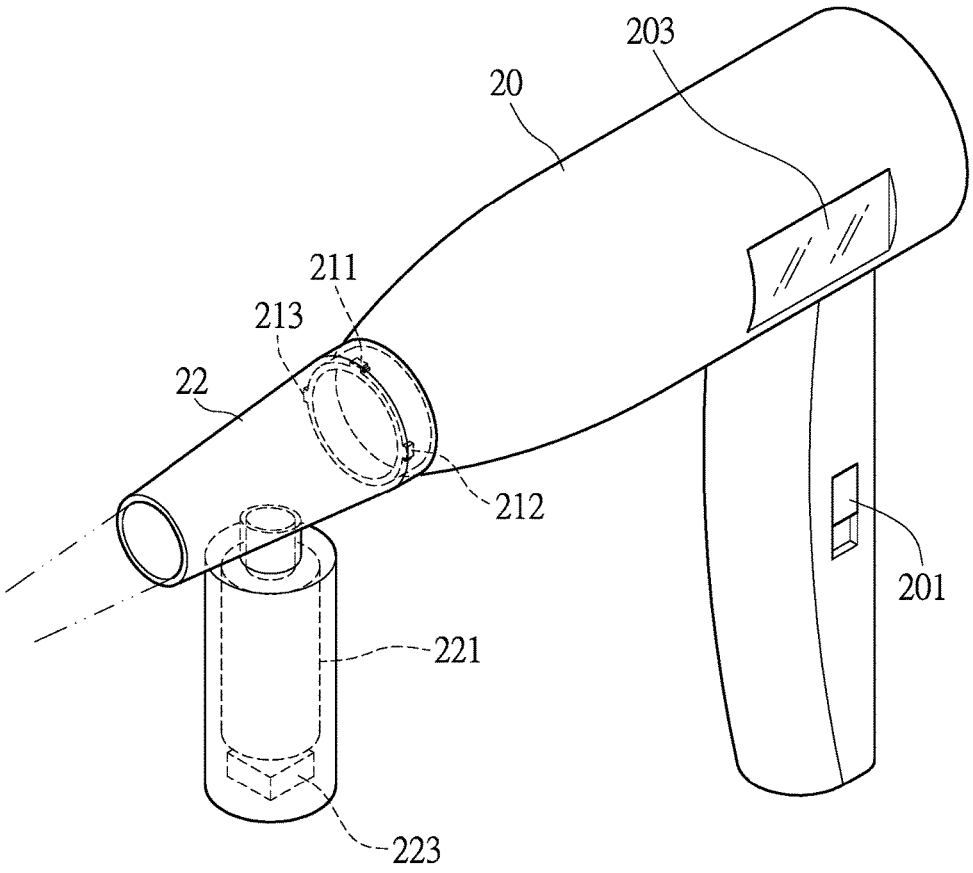
FIG. 2 shows a schematic diagram depicting a system including the blowing apparatus capable of expanding function and its expansion device according to one further embodiment of the present invention.

In FIG. 2, another example shows a system including the blowing apparatus and an expansion device in one embodiment of the present invention. A display screen 203 may be mounted upon the blowing apparatus 20. The display screen 203 connects to internal display circuits, and displays operational messages retrieved from inside circuits. For example, the display screen 203 displays power indication, temperature, and fan speed. The display screen 203 can show information related to the operating mode of the connected expansion device and/or its function. The blowing apparatus 20 has a power switch 201 that can be a common power switch, or a switch allowing the user to switch to one of the operating modes; or manually switch the multi-stage fan speeds and/or temperatures.

The expansion device in the present example can be a mist-type expansion device 22. The expansion device has a structure for locking the mist-type expansion device 22. The expansion device 22 can be locked to the blowing apparatus 20 by a rotatable structure. The expansion device 22 can utilize a latch to engage with the blowing apparatus 20. The expansion device 22 may also be set into the blowing apparatus 20 through a particular mechanical design. Further, a magnetic connector can be used to combine the blowing apparatus 20 and the expansion device 22. The contact pins of the expansion device 22 may be integrated in the magnetic connector. While the blowing apparatus 20 is combined with the mist-type expansion device 22, the mentioned connecting structure helps to align the expansion device 22 and the blowing apparatus 20. The contact pin(s) can correspondingly contact with the electrical pin(s) 211, 212, 213 for transferring electric power, and allowing for identifying the operating mode of the expansion device 22. The contact pin is configured to be one or more pins.

The expansion device 22 is essentially used to spray the mist generated from the liquid or substance in the container 221. The mist generating unit 223 generates the mist through vibration or another scheme. The mist is sprayed out of the outlet of the container 221, and enters the outlet cap of the expansion device 22. The blowing apparatus 20 blows the air under a fan speed and a temperature. The mist generated by the mist-type expansion device 22 produces mist with a specific effect due to the shape of the outlet cap.

Figure 3:
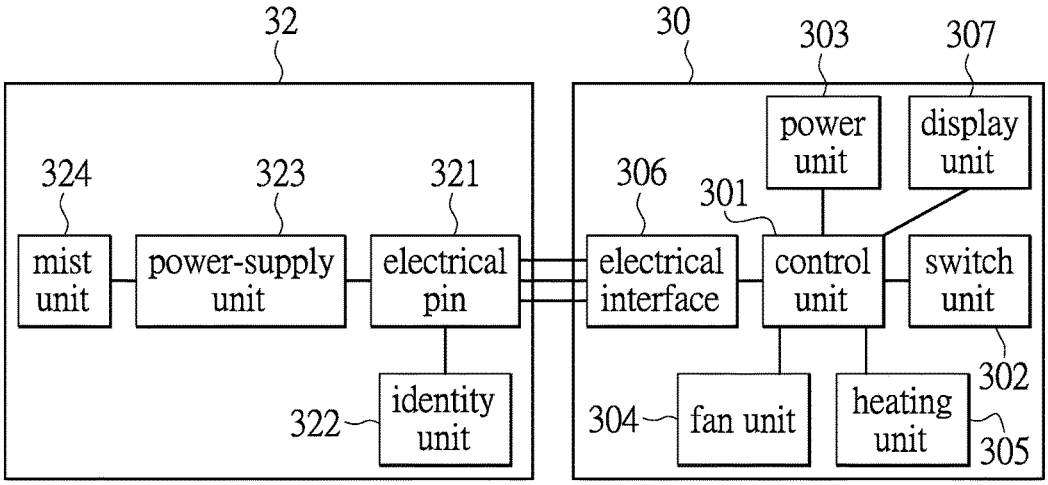
FIG. 3 shows a block diagram of circuits implementing the system including the blowing apparatus and the expansion device in one embodiment of the present invention.

Reference is made to FIG. 3 describing a block diagram of the blowing system in one embodiment of the present invention. The block diagram includes the essential circuit components of the blowing apparatus and the components of the expansion device.

The blowing apparatus 30 includes a control unit 301 which is a control circuit electrically connected to other circuit components. The circuit unit 301 is used to process signals among the circuit components of the blowing apparatus 30. The control unit 301 determines the type of the expansion device 32 according to the electrical features of the expansion device 32. For example, this expansion device is identified by its operating mode rendered by a mist-type expansion device 32 connected with the blowing apparatus 30. The operating mode can be recognized according to the identity signal.

The blowing apparatus 30 has a switch unit 302 for switching power supply. The switch unit 302 can be a multi-stage switch for manually switching the multiple operating modes. The blowing apparatus 30 includes a power unit 303 that is a power control circuit for this apparatus using an AC power or a DC power.

The blowing apparatus 30 has an electrical interface 306 that is positioned around the outlet of the blowing apparatus 30. The electrical interface 306 including one or more electrical pins is at the position contacted with the expansion device 32. The electrical pin(s) can be correspondingly connected with the contact pin(s) 321 of the expansion device 32. The connection interface, or part of the electrical interface 306, has a connector structure for locking the mist-type expansion device 32.

The blowing apparatus 30 has a fan unit 304. The fan unit 304 is electrically connected with the control unit 301. The control unit 301 controls the rotating speed of the fan unit 304 in response to the identity signal. The rotating speed can be adjustable or controllable, for example, it can be increased, maintained as original, decreased, or changed over time as required. A heating unit 305 is electrically connected with the control unit 301. By the control unit 301, the adjustable/controllable temperature of the heating unit 305 can be controlled according to the identity signal so as to raise temperature, maintain original temperature, lower temperature, or change temperature over time.

The blowing apparatus 30 may have a display unit 307 which is electrically connected with the control unit 301. The display unit 307 embodies a display screen mounted upon the housing of the blowing apparatus 30. For example, the display screen 203 of FIG. 2 can be an LED or LCD display. The display unit 307 is used to display messages based on the signals instructed by the control unit 301. The messages displayed on the display screen are such as state of electric power supplied to the apparatus, the type and function of the connected expansion device, the output temperature of the heating unit 305, and/or the rotating speed of the fan unit 304.

The mist-type expansion device 32 is in fact an external device to the blowing apparatus 30. The expansion device 32 can be locked to the blowing apparatus 30 via a locking structure. The outlet cap of the expansion device 32 is designed for a specific function. The identification information with respect to the expansion device 32 is related to its type and an operating mode. The connection interface for combining the blowing apparatus 30 and the expansion device 32 includes one or more electrical pins forming the electrical interface 306. The information recorded by the electrical pins allows the control unit 301 of the blowing apparatus 30 to recognize the expansion device 32, including its operating mode. In an exemplary example, the connection interface of the expansion device 32 has a locking member with respect to the connecting structure of the blowing apparatus 30. Further, the connection interface has the contact pin(s) 321 correspondingly contacted with the electrical pin(s) when the two devices are assembled.

A power-supply unit 323 is disposed in the expansion device 32. The power-supply unit 323 supplies requisite power to operate the mist-type expansion device 32. The power-supply unit 323 is electrically connected to the contact pin(s) 321 connection interface between the two devices. Through the contact pin(s) 321 and the electrical interface 306, the electric power of the blowing apparatus 30 can be transferred to the expansion device 32.

The expansion device 32 has an identification unit 322 electrically connected with one or more contact pins 321 of the connection interface of the expansion device 32. The identification unit 322 can be a circuit assembly forming an identification circuit, a dip switch, or a memory for recording the identification code of the expansion device 32. The identification unit 322 records the operating mode of the expansion device 32. The operating mode is provided for the control unit 301 of the blowing apparatus 30 to identify the expansion device 32.

The mist-type expansion device 32 includes a mist unit 324. The mist unit 324 has a container and a mist generating unit. The power-supply unit 323 supplies power to the mist unit 324. The mist generating unit is driven to mist the liquid or substance in the container. The liquid or the substance is misted and sprayed out of the outlet cap of the expansion device 32.

While the mist-type expansion device 32 is combined with the blowing apparatus 30, the control unit 301 identifies the expansion device 32 and its operating mode by its identification unit 322. The control unit 301 controls the operating parameters for the blowing apparatus 30 according to the identified operating mode of the expansion device 32. The operating parameters are such as a rotating speed of the fan unit 304 and/or the temperature of the heating unit 305. In one further embodiment, the mist unit 324 can be electrically connected to the contact pin(s) 321, and can be controlled to adjust density of the mist produced by the mist unit 324.

Figure 4:
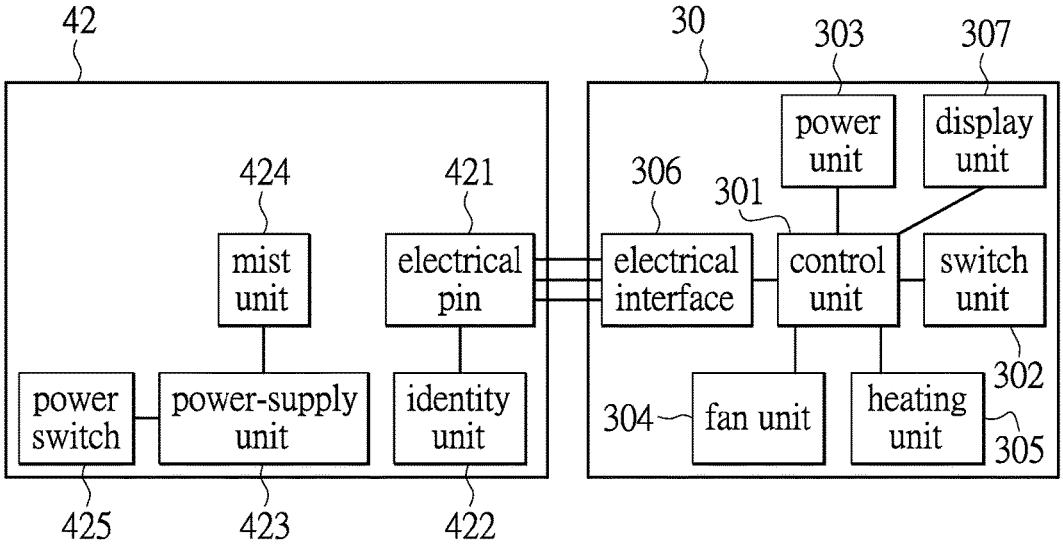
FIG. 4 shows another block diagram of circuits implementing the blowing apparatus and the expansion device according to one of the embodiments of the present invention.

FIG. 4 shows another block diagram describing the circuits of the blowing apparatus in one further embodiment of the present invention.

The blowing apparatus 30 essentially includes a control unit 301, a switch unit 302, a power unit 303, a fan unit 304, heating unit 305, and an electrical interface 306. The control unit 301 also controls the operating parameters according to the identified operating mode of the expansion device. A display unit 307 may also be included in the blowing apparatus 30.

In the present example, the expansion device has an independent power supply, e.g. a power-supply unit 423. This power supply supplies power to a mist unit 424 which is electrically connected with a power-supply unit 423. A power switch 425 is also provided. The power-supply unit 423 can be a battery set, or a circuit connected to an AC power. The power switch 425 can be a common switch. The power switch 425 can be electrically connected to the connection interface between the expansion device 42 and the blowing apparatus 30. The expansion device 42 is activated once the two devices are correctly coupled.

The expansion device 42 includes contact pin(s) 421 corresponding to the electrical pin(s) of the blowing apparatus 30. The expansion device 42 has an identification unit 422 for recording the information provided for the blowing apparatus 30 to identify its connected expansion device 42.

The operating mode of the mist-type expansion device can be a steam iron mode, a hair-moisturizing mode, a steam-beauty mode, or a humidifying mode. The operating mode corresponds to a set of operating parameters for operating the fan unit and the heating unit of the blowing apparatus 30. In one further embodiment, the density of mist produced by the mist unit may also be referred to in the operating mode. FIG. 5A through FIG. 5D respectively describes various types of the blowing apparatus of the present invention. It is noted that the scope of the present invention is not limited to the embodiments described in the disclosure.

Figure 5A:
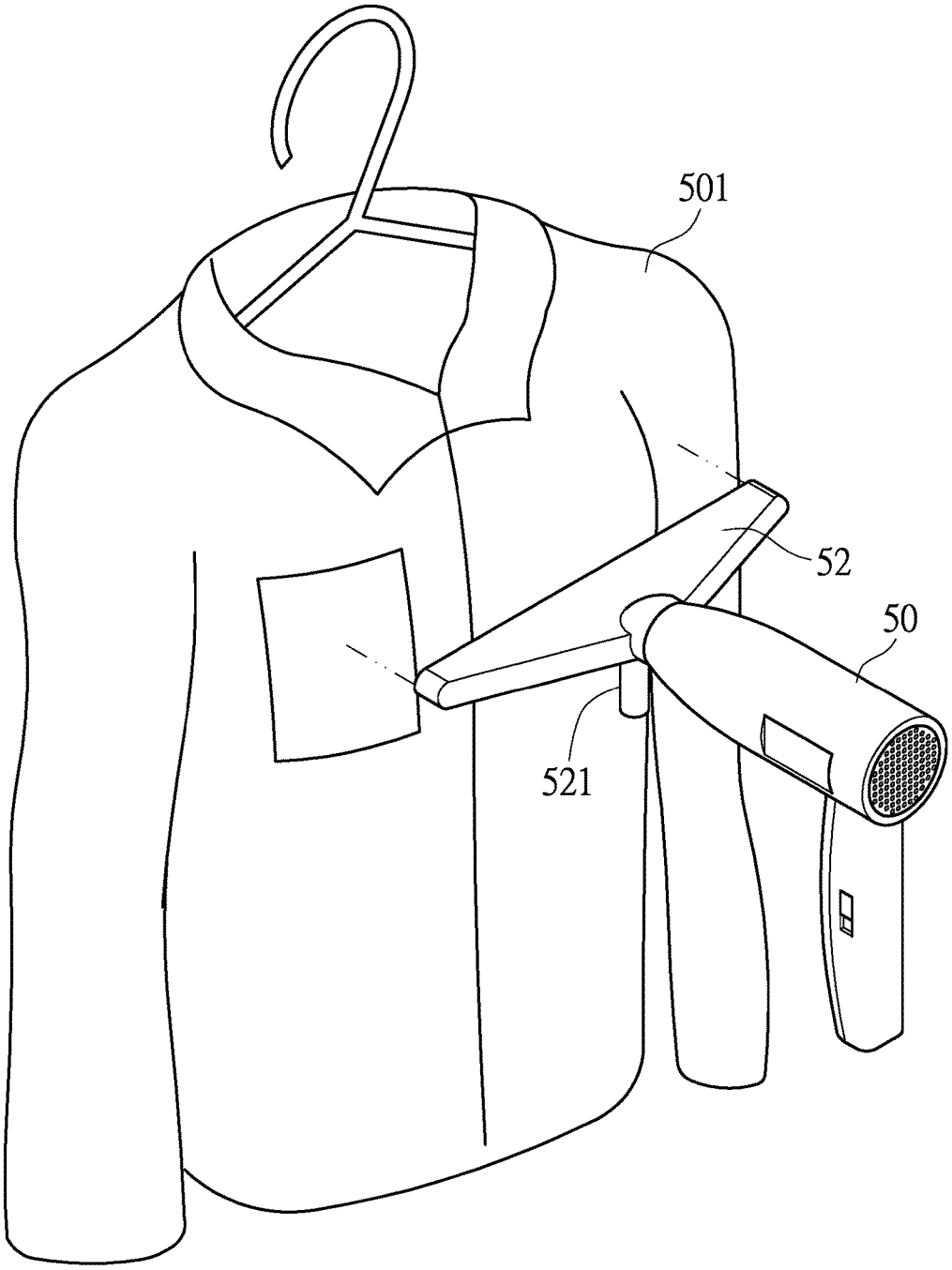
FIG. 5A through FIG. 5D schematically show the blowing apparatus in multiple types of embodiments of the present invention.

FIG. 5A schematically shows a blowing apparatus implementing a garment steamer by combining an expansion device in one embodiment of the present invention.

The combination of the blowing apparatus 50 and a mist-type expansion device 52 embodies a device for hanging and ironing clothes 501. The outlet cap is configured to fit the requirement of the garment steamer. When the blowing apparatus 50 and the expansion device 52 are combined, the control circuit of the blowing apparatus 50 identifies the operation mode of the expansion device 52, and accordingly adjusts operating parameters for the fan unit and heating unit.

A mist unit 521 of the expansion device 52 has a container for containing a liquid or substance. After the rotating speed of the fan unit and temperature of the heating unit have been adjusted or controlled, a mist generating unit produces the mist, and the mist is sprayed out of the outlet cap. The output mist with the fan speed and the temperature can be used to iron the clothes 501.

Figure 5B:
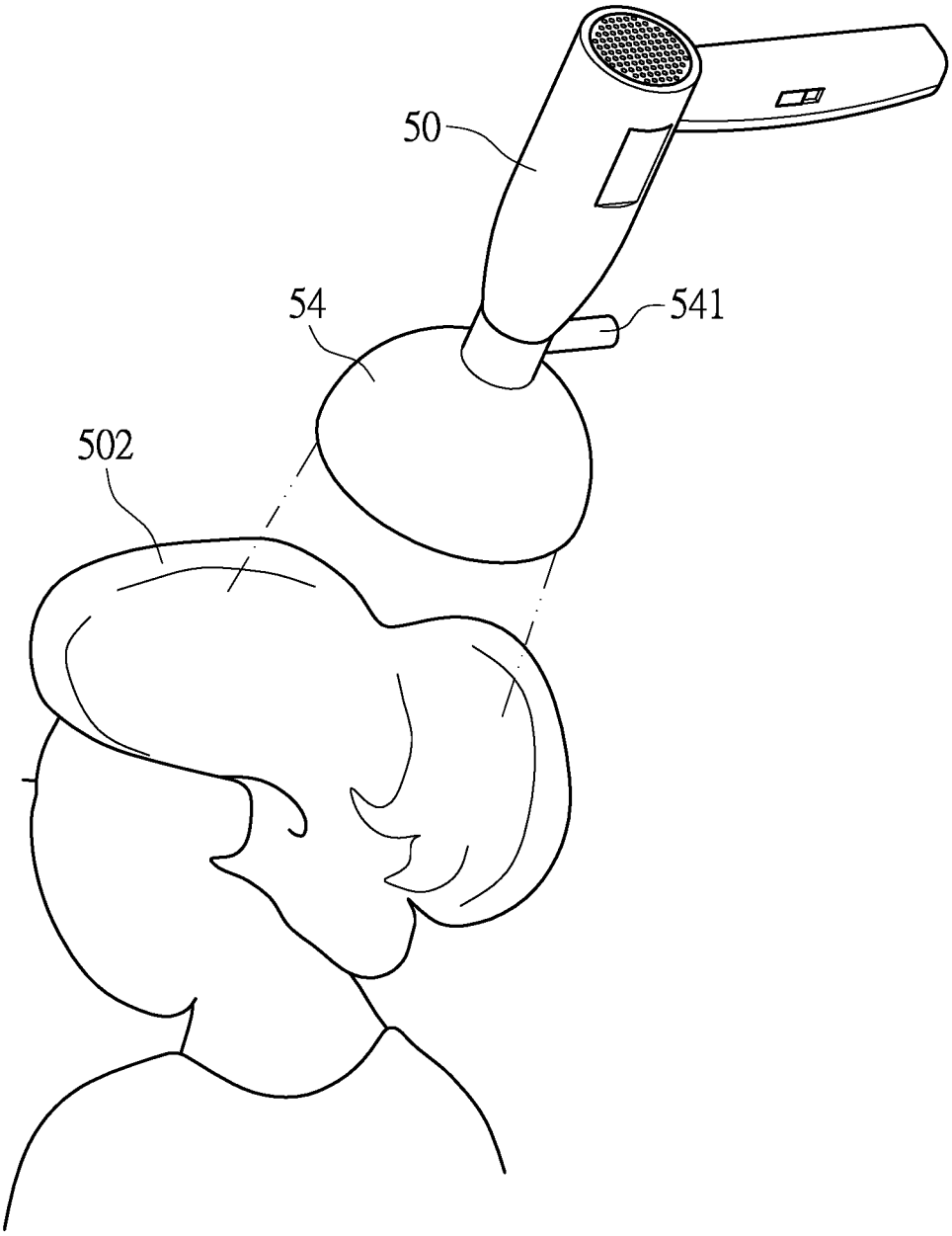

FIG. 5B shows another schematic diagram of the blowing apparatus implementing a hair humidifier in one embodiment of the present invention.

The blowing apparatus 50 is combined with another mist-type expansion device 54. The mist-type expansion device 54 is used to humidify hair 502. A mist unit 541 in the expansion device 54 generates mist. The mist enters the outlet cap of the expansion device 54. The operating parameters for the fan unit and heating unit of the blowing apparatus 50 are configured according to its operating mode. Therefore, a suitable fan speed and temperature are applied to the mist sprayed in the outlet cap. Therefore, the hair can be humidified through this combination of the blowing apparatus 50 and the expansion device 54.

Figure 5C:
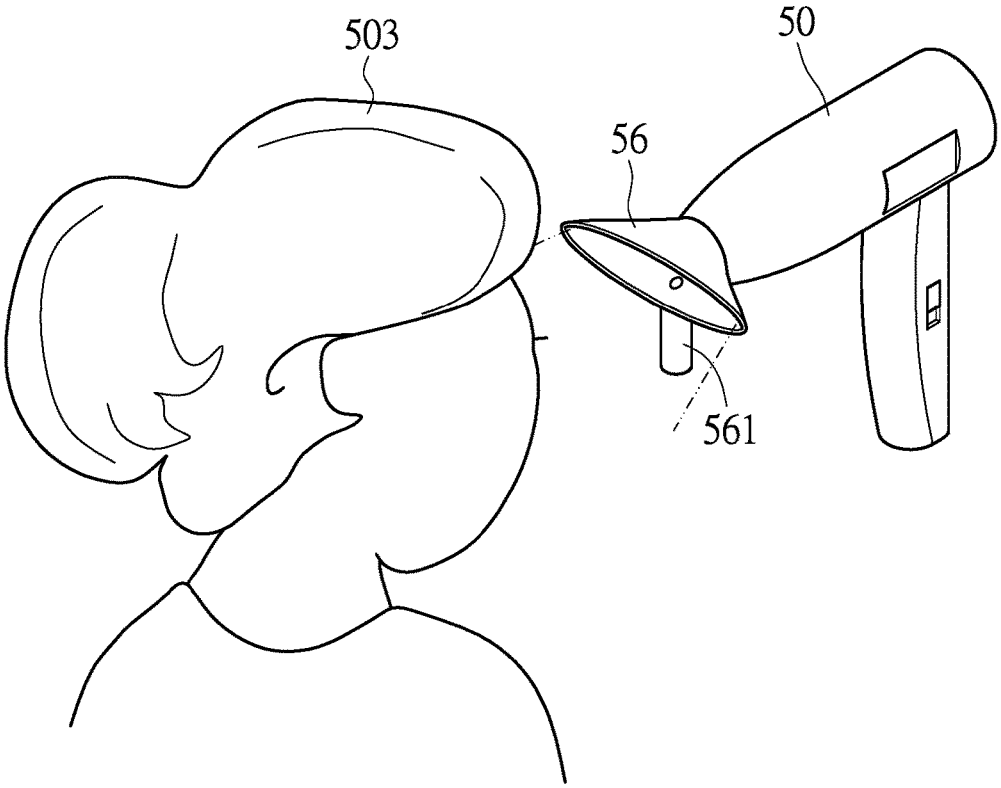

FIG. 5C shows a schematic diagram of the blowing apparatus 50 implementing a steaming device as combined with an expansion device 56. The blowing apparatus 50 is combined with the mist-type expansion device 56 having a specific type of outlet cap. When a mist unit 561 in the expansion device 56 sprays the mist, the fan unit and heating unit of the blowing apparatus 50 allow the mist to be blown under a specific rotating speed and a heating temperature. The outlet cap further allows the mist to be output within a specific range for steaming the human face 503.

Figure 5D:
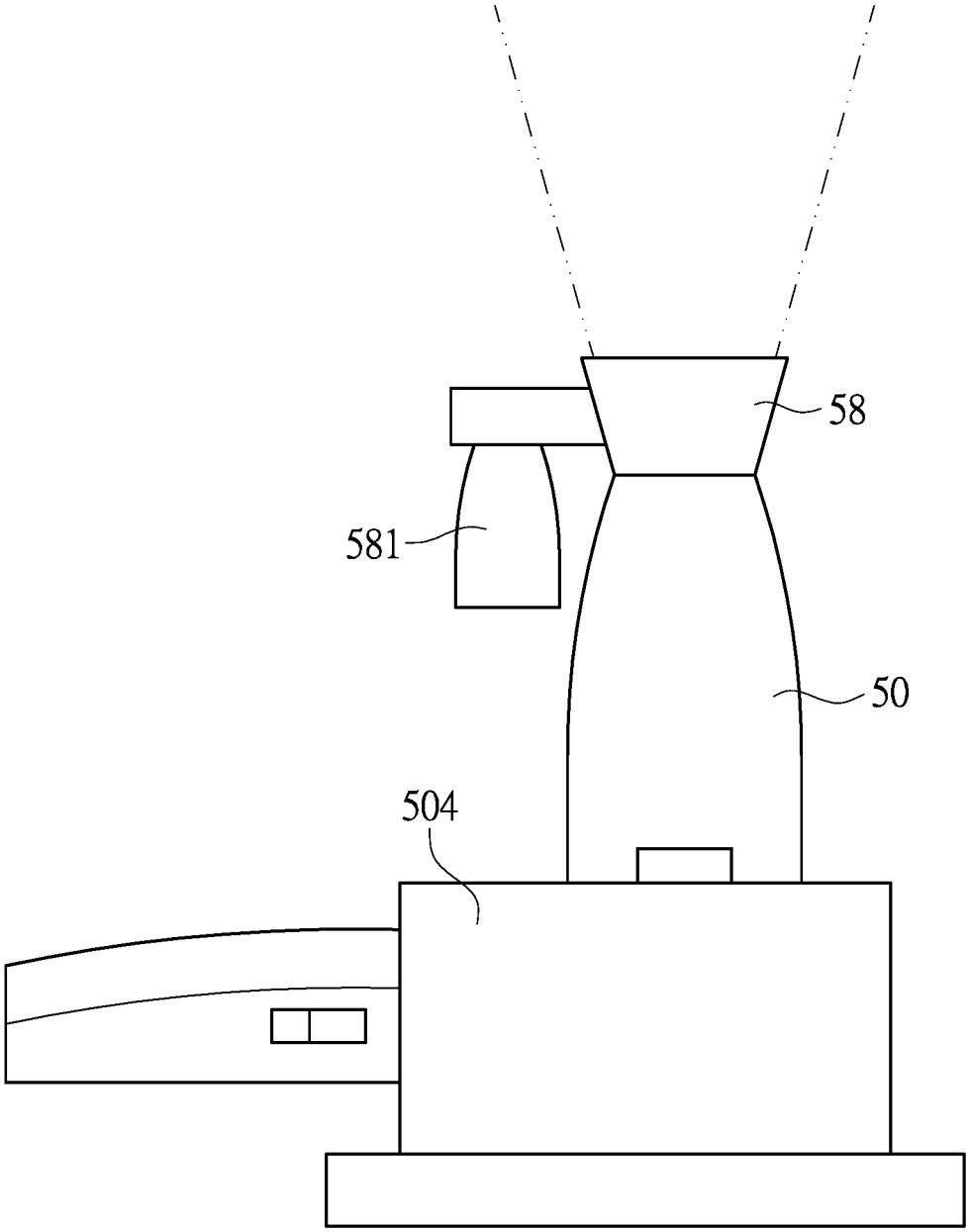

FIG. 5D shows a schematic diagram of another type of expansion device combined with the blowing apparatus that serves as an indoor humidifier or water-oxygen machine. The blowing apparatus 50 connects to the mist-type expansion device 58 that is fixed in a base 504. The outlet cap is configured to have an upward opening. The outlet cap can also be other configurations as required. The mist-type expansion device 58 has a mist unit 581 that produces mist entering to the outlet cap. The blowing apparatus 50 adjusts its operating parameters based on the identified operating mode of the mist-type expansion device 58. The mist is blown out under the specified fan speed and temperature so as to embody a humidifier or a water-oxygen machine.

Figure 6:
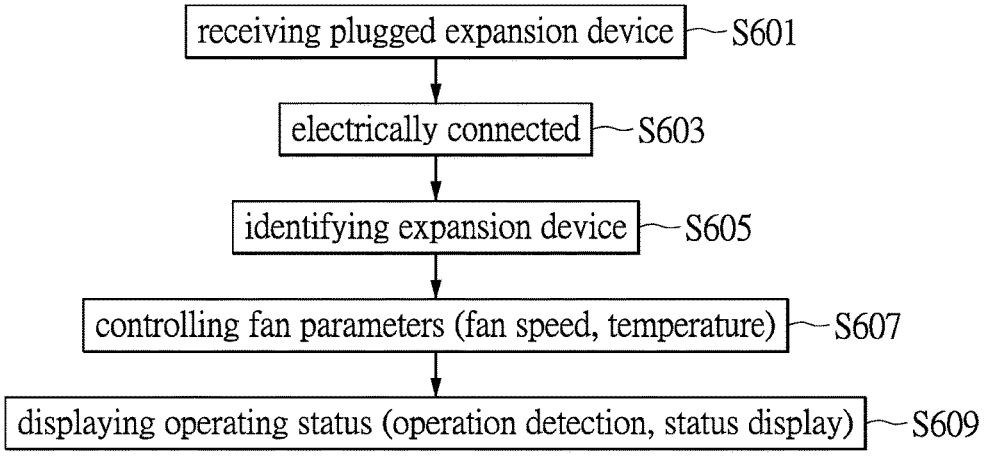
FIG. 6 shows a flow chart describing an operating process for operating the system according to one embodiment of the present invention.

The process in one embodiment to operate the blowing system with the apparatus combined with an expansion device for achieving a specific function is referred to the flow chart shown in FIG. 6.

In the beginning, such as in step S601, the blowing apparatus is connected with a mist-type expansion device via a connection interface. The connection interface is correspondingly coupled to the electrical interface of the blowing apparatus, such as in step S603. The control unit of the blowing apparatus can acknowledge a mist-type expansion device has been connected with the blowing apparatus. The control unit also identifies the expansion device, such as in step S605, and acknowledges an operating mode of the expansion device. The control unit then determines a set of operating parameters by reading an identification code from the expansion device. The operating parameters are related to a rotating speed of a fan in the blowing apparatus and/or a temperature of a heater, or adding the density and flow rate of the mist. The rotating speed of the fan can be adjustable or controllable. The temperature of the heater can be adjustable or controllable, for example the temperature can be raised, maintained as original temperature, lowered or changed over time.

Next, the control unit of the blowing apparatus controls the operating parameters such as the fan speed and temperature of the heater, such as in step S607. The mist unit sprays the mist into the outlet cap of the expansion device, such as in step S609, the operating status can be displayed through a display screen.

Thus, when the blowing apparatus with expandable function is in operation, the blowing apparatus can determine the type of the expansion device, and also acquire its operating parameters. The operating parameters are such as a temperature of a heating unit and a rotating speed of a fan unit. Then the blowing apparatus can be configured for achieving a specific function using the operating parameters.

It is intended that the specification and depicted embodiment be considered exemplary only, with a true scope of the invention being determined by the broad meaning of the following claims.

What is claimed is:

1. A system including a blowing apparatus with expandable function and an expansion device, comprising:

the blowing apparatus comprising:

a control unit, used to identify an operating mode of the expansion device being connected with the blowing apparatus, and generate an identity signal according to the operating mode of the expansion device, and processing signals for the blowing apparatus;

an electrical interface, electrically connected with the control unit, including one or more electrical pins for electrically connecting to the expansion device;

a fan unit, electrically connected with the control unit, used to control a rotating speed according to the identity signal generated by the control unit;

a heating unit, electrically connected with the control unit, used to control a temperature according to the identity signal;

a switch unit, electrically connected with the control unit, used for manually switching multiple operating modes of the expansion device; and a display unit, electrically connected with the control unit, used to indicate operating status of the blowing apparatus;

the expansion device applied to the blowing apparatus, comprising:

a first connection interface configured to have one or more contact pins corresponding to one or more electrical pins of the blowing apparatus, and a locking member with respect to a connecting structure of the blowing apparatus; and an identification unit, electrically connected with the one or more contact pins of the first connection interface, used to record the operating mode of the expansion device, and allow the control unit of the blowing apparatus to identify the operating mode of the expansion device;

wherein, while the expansion device is connected to the blowing apparatus, the control unit of the blowing apparatus acknowledges the operating mode of the expansion device from the identification unit, and the control unit automatically controls the rotating speed of the fan unit of the blowing apparatus, and/or the temperature of the heating unit according to the identified operating mode of the expansion device;

wherein, a power-supply unit of the blowing apparatus is electrically connected with the one or more contact pins of the first connection interface of the expansion device, and the expansion device obtains electric power from the blowing apparatus;

wherein the expansion device is a mist-type expansion device including a mist unit, a container and a mist generating unit, and is powered by the power-supply unit that allows the mist generating unit to generate mist, sucked by blowing air and mix with air, spray out of an outlet can of the mist-type expansion device by vibrating liquid in the container;

wherein the operating mode of the mist-type expansion device is a steam iron mode, a hair-moisturizing mode, a steam-beauty mode, or a humidifying mode.

2. The system according to claim 1, wherein the blowing apparatus has a second connection interface for connecting to the expansion device, and the second connection interface includes one or more electrical pins that are used to identify the operating mode of the expansion device.

3. The system according to claim 2, wherein the one or more electrical pins are used to transfer power to the expansion device.

4. An expansion device applied to a blowing apparatus with expandable function, comprising:

a connection interface configured to have one or more contact pins corresponding to one or more electrical pins of the blowing apparatus, and a locking member with respect to a connecting structure of the blowing apparatus; and an identification unit, electrically connected with the one or more contact pins of the connection interface, used to record an operating mode of the expansion device, and allow a control unit of the blowing apparatus to identify the operating mode of the expansion device;

wherein, while the expansion device is connected to the blowing apparatus, the control unit of the blowing apparatus acknowledges the operating mode of the expansion device from the identification unit, and the control unit automatically controls a rotating speed of a fan unit of the blowing apparatus, and/or a temperature of a heating unit according to the identified operating mode of the expansion device;

wherein, a power-supply unit is electrically connected with the one or more contact pins of the connection interface, and the expansion device obtains electric power from the blowing apparatus;

wherein the expansion device is a mist-type expansion device including a mist unit, a container and a mist generating unit, and is powered by the power-supply unit that allows the mist generating unit to generate mist, sucked by blowing air and mix with air, spray out of an outlet cap of the mist-type expansion device by vibrating liquid in the container;

wherein the operating mode of the mist-type expansion device is a steam iron mode, a hair-moisturizing mode, a steam-beauty mode, or a humidifying mode;

wherein a switch unit of the blowing apparatus is electrically connected with the control unit of the blowing apparatus and used for manually switching multiple operating modes of the expansion device.

5. The expansion device according to claim 4, wherein the identification unit is a circuit assembly, or a memory recording an identification code of the expansion device.

6. The expansion device according to claim 1, wherein, a venturi tube with an altering cross section is disposed inside the outlet cap of the expansion device for enhancing the mist sprayed out of the outlet cap.

7. The expansion device according to claim 6, wherein the identification unit is a circuit assembly, or a memory recording an identification code of the expansion device.

8. An operating method for operating the system according to claim 1, comprising:

identifying the expansion device connected with the blowing apparatus, and acquiring the operating mode of the expansion device, wherein the expansion device is connected with the electrical interface of the blowing apparatus through the first connection interface of the expansion device, and the operating mode is acquired from the identification unit via the one or more electrical pins; and in response to the operating mode, controlling a rotating speed of a fan unit of the blowing device; and/or controlling a temperature of a heating unit of the blowing device.

9. The method according to claim 8, wherein the identification unit is a circuit assembly, or a memory recording an identification code of the expansion device.

10. The method according claim 8, wherein the expansion device is a mist-type expansion device including a mist unit, a container and a mist generating unit, and is powered by the power-supply unit that allows the mist generating unit to generate mist sprayed out of an outlet cap of the mist-type expansion device by vibrating liquid in the container.

* * * * *